US006745738B1

(12) United States Patent
Bosscher

(10) Patent No.: US 6,745,738 B1
(45) Date of Patent: Jun. 8, 2004

(54) PNEUMATIC VALVE RETURN SPRING

(76) Inventor: Richard J. Bosscher, 4735 Kamloop Ave., #63 San Diego, CA (US) 92117

( * ) Notice: Subject to any disclaimer, the term of this patent is extended or adjusted under 35 U.S.C. 154(b) by 0 days.

(21) Appl. No.: 10/246,096

(22) Filed: Sep. 17, 2002

Related U.S. Application Data

(60) Provisional application No. 60/322,705, filed on Sep. 17, 2001.

(51) Int. Cl.[7] ..... F01L 3/10

(52) U.S. Cl. ..... 123/90.65; 123/90.14; 123/90.12; 123/90.15

(58) Field of Search ..... 123/90.65, 90.11, 123/90.14, 90.12, 90.15, 90.16, 90.17

(56) References Cited

U.S. PATENT DOCUMENTS 3,572,299 A * 3/1971 Lester ..... 123/90.25
4,592,313 A 6/1986 Speckhart
4,831,973 A 5/1989 Richeson, Jr.
4,883,025 A 11/1989 Richeson, Jr.
5,109,812 A 5/1992 Erickson et al.
5,553,572 A 9/1996 Ochiai
5,586,529 A 12/1996 Vallve
5,713,316 A * 2/1998 Sturman ..... 123/90.12
5,762,035 A * 6/1998 Schebitz ..... 123/90.11
5,943,988 A 8/1999 Burger et al.
5,988,124 A 11/1999 Duesmann
6,244,234 B1 6/2001 Hoeg

* cited by examiner

*Primary Examiner*—Thomas Denion
*Assistant Examiner*—Jaime Corrigan
(74) *Attorney, Agent, or Firm*—Donn K. Harms

(57) ABSTRACT

A valve spring device using pressurized gas for use in biasing a reciprocating valve which moves between a seated position and open position. The device features a static housing having a static chamber what is translateably engaged with dynamic housing. Chambers inside both housings are sealably engaged such that the dynamic housing translates away from the static housing when pressurized gas is communicated to the engaged sealed chambers thereby biasing the dynamic housing away from the static housing and moving the attached valve. Timing of oscillation of the translation and resulting valve timing is controlled by a controller activating a control valve between a pressurizing state and a venting state. The timing may be adjusted to accommodate the engine timing through varying the controller's activation of the control valve and optionally varying the pressure of the gas using a regulator.

15 Claims, 3 Drawing Sheets

PNEUMATIC VALVE RETURN SPRING

This application claims the benefit of U.S. Provisional Application No. 60/322,705 filed Sep. 17, 2001.

BACKGROUND OF THE INVENTION

1. Field of the Invention

The present invention relates to valve return springs. More particularly it relates to a device which replaces conventional metal valve return springs with pneumatic spring returns. The device is suited for use on a wide variety of applications where metal return springs are conventionally employed to bias valves toward a first position opposing a mechanical or other force which moves the valves toward and to, a second position. The device is especially well suited for retrofiting conventional mechanical valve return spring assemblies used on internal combustion and other cycled engines. However, it would also serve well as an original equipment pneumatic valve return spring to replace conventional spring assemblies and provide a wide degree of utility and performance improvement in both the function and timing of such valve assemblies used on internal combustion and other engines employing valves for venting and/or intake.

2. Prior Art

Valve springs are widely used throughout the world on a wide variety of applications. Generally, the valve spring is used to bias the valve against an opposing force usually generated by a cam or valve actuating lever acting on the valve to force it toward, and to, a second or open position. The force provided by the valve return spring acts to return the valve to the first or closed position where the valve head is seated in a valve seat thus sealing the aperture inside the valve seat communicating with a chamber which is vented or filled through the aperture in the valve seat surrounding the valve head.

Such an arrangement is quite popular in the operation of internal combustion engines using gasoline, diesel, or similar combustive fuels where valve springs are conventionally used to bias intake and exhaust valves toward a first closed position by imparting a biasing force to counter the biasing force from a mechanical lever such as a valve lifter or cam lobe that imparts force on the actuating end of the valve to bias it toward a second or open position.

Conventional spring and valve assemblies suffer from a number of problems. One such problem is that of metal fatigue of the springs themselves which can cause them to break and the valve to fail with major mechanical failure consequences in engines turning at high revolutions. A second concern is that of valve timing which tends to be set by the mechanical cam or other device powering the valve lifter imparting force to the valve stem. In purely mechanical valve spring arrangements, varying the timing of the valves to achieve better fuel economy or engine performance is extremely complicated and unreliable and thus generally not worth the effort due to the potential consequences from an increased risk of failure of the valve system. Such purely mechanical valve spring systems also suffer from other maladies during high revolutions of the engine in that they tend to float or fail to close the valve quickly enough resulting in loss of performance and sometimes engine failure should the float be too extreme.

In an attempt to overcome such problems associated with mechanical spring systems, pneumatic or fluid actuated valve systems have been tried to provide the biasing means for such valves to resist the force imparted by the valve lever and return the valve to its seat once the cycle is complete. Pneumatic systems, using compressible gas, provide the ability to vary the force and timing of the valve closure and to overcome the shortcomings of mechanical spring valve biasing systems. Such pneumatic assemblies however, often require exotic dedicated cylinder head assembly machining utilizing drilled air supply distribution passages, integral valve return spring operating bores, complex valve stem seals, oiling arrangements, sealing bellows and sophisticated air control arrangements. Such exotic purpose-built or dedicated cylinder head valve operating systems remain largely unavailable due to the extreme costs involved with engineering, testing and manufacturing. All of these attempts add to the complexity and cost of a high performance competitive engine and tend to reduce the inherent reliability of the same. As a consequence, such pneumatic valve biasing assemblies are virtually impossible to use to retrofit the millions of existing internal combustion engines and are not cost effective when used as original equipment due to the major amount of machining and retooling required to implement the current complicated systems. However, various prior art has attempted to provide a pneumatic valve spring system suitable for use on internal combustion engines.

U.S. Pat. No. 4,592,313 (Speckhart) teaches a pneumatic valve return for intake or exhaust valves. Speckhart uses an upper piston attached to and acting on a valve stem when pressure from a pressurized gas supply is communicated to the upper piston. However, Speckhart is not easily retrofited to the millions of existing engines due to its interface with the valve. Also, Speckhart communicates the pressurized air in the pneumatic spring directly to the valve stem itself thereby causing sealing problems.

U.S. Pat. No. 5,586,529 (Vallve) discloses a pneumatic valve spring member that replaces the conventional valve spring. However, the dual donut or flexible baffle arrangement taught by Vallve would be unreliable in the high heat and friction environment encountered by valve springs in internal combustion engines.

U.S. Pat. No. 5,943,988 (Burger) teaches a gas change valve for internal combustion engines. However, Burger requires the use of an electromagnetic structure and a switching system in combination with an electro-pneumatic means for gas pressure. Burger is thus not an easy or desirable retrofit to existing vehicles and requires a complicated electromagnet system which would increase cost and would be prone to failure in the high heat and oily environment of engine valves.

U.S. Pat. No. 5,109,812 (Ericson) features a double pneumatic spring to translate a valve in both directions and eliminate the requirement for a valve actuating lever and/or cam. However, Ericson by design is not easily installed to retrofit existing valve springs on engines and even as original equipment would require a complete redesign of valve actuation in conventional internal combustion engines.

As such, there is a continuing need for improvement in valve biasing devices used to provide a force to bias valves which seal chambers to their closed or sealed position. Such a device should be simple in both operation and construction rendering it simple to install and maintain. Further, such a device should be easily installed as a retrofit to currently used valve springs on internal combustion engines in use today. Still further, such a device should be constructed to operate reliably in the high heat and oily environment of valve springs of internal combustion engines and should not easily fail.

SUMMARY OF THE INVENTION

The applicant's device is an improved pneumatic valve return spring and system for operation, biasing force control, and operation thereof. The device in its simplest form to replace a conventional circular valve spring features a plurality of housings.

A static housing that is essentially donut shaped is mounted to a fixed position on a cylinder head wherein an aperture defined by an inner wall of the housing surrounds a conventional valve stem. An outer wall of the static housing, circumferentially parallel and substantially equally spaced from its inner wall, communicates with the inner wall on a bottom side and thereby defines a static housing chamber. An open side opposite the bottom side forms a static circular aperture communicating with the static housing chamber.

A dynamic housing, is shaped similar to the static housing also has an inner wall that surrounds a valve stem and is dimensioned for lateral engagement with the static housing. The inner wall is connected by a top wall to a circumferentially parallel outer wall equally spaced from the inner wall. A reciprocating chamber is defined by the inner wall, outer wall and top wall and communicates on an open side opposite the top side with a circular opening.

The circular opening of the dynamic housing is sized to accommodate the lateral translation of the reciprocating chamber over the inner and outer walls of the static housing with the reciprocating chamber in sealed communication with the static chamber using conventional seals such as O rings adjacent to the open side of the dynamic housing and the circular aperture of the static housing.

With the dynamic housing in operating position and engaged over the static housing, the two inner walls of both housings define a valve stem chamber that is sized to accommodate a valve stem therein and a valve guide if necessary. A biasing means such as a conventional coil spring surrounds the valve stem and biases the valve and dynamic housing attached to the distal end of the valve, toward a closed position. However, this biasing spring provides minimal biasing force only to maintain the dynamic housing in an elevated position when air pressure falls below a certain level.

The sealed engagement of the reciprocating chamber with the static chamber form an expansion chamber surrounding, but not communicating with, the valve stem. This expansion chamber will both contract and elongate when the dynamic housing reciprocates in its engagement over the static housing. Of course those skilled in the art will readily see that the dynamic chamber might also reciprocate into the static chamber by changing the inner and outer wall dimensions of both housings, and such is anticipated, however the current best mode of the device features the dynamic housing reciprocating over the static housing and the reciprocating chamber sized to translate over the inner and outer walls forming the static chamber.

In use, a pressurized air fluid supply would be communicated into the static chamber and would expand and thereby force the dynamic housing to translate away from the static housing by fluid pressure acting on the reciprocating chamber when communicated from its sealed engagement with the static chamber. This pressurized air supply would be provided by a pump or other means to provide a pressurized air supply to the static chamber through one or a plurality of conduits communicating in sealed engagement with the static chamber. When so communicated, the air pressure expands into the reciprocating chamber forcing the dynamic housing and attached valve away from the static housing thereby closing the valve into its seat and holding it there in biased engagement with a valve seat until the air pressure in the formed expansion chamber is vented using a means to vent the expansion chamber such as a conduit communicating therewith. Of course a valving means to open and close the conduit used to vent the expansion chamber as well as the conduit feeding pressurized gas to the static chamber would be used to time the pressurization and depressurization of the expansion chamber with the cycles of the engine to provide a means to time the opening and closing of the valve to its seat. Controlling these valves along with the amount of pressure forced into the static chamber when pressurizing it, would also provide a means for variable timing of the valve from its open position forced down by the cam or actuating lever, to its closed position with the valve head in the seat.

The air pressure inside the expansion chamber in this unique design is kept away from the valve stem and stem seals which seal the circumference of the valves and thus no modification is required as would be the case if this area was pressurized. Further, the reciprocating donut design allows for the device to easily be inserted in place of existing mechanical springs on conventional engines by placing the device in the spot where the original valve spring occupied and engaging it with the distal end of a valve in the conventional fashion. An optional oil drain passage provides a vent for any oil that would proceed past the valve seals.

It is therefor an object of this invention to provide a pneumatic spring device which is easily retrofitted in place of existing valve springs on internal combustion engines and other sites where such biasing valve springs are currently used.

Another objective of this invention is to provide such a pneumatic valve spring device which is simple in construction and installation and requires little or no modification to be inserted in place of conventional valve springs.

A further objective of this invention is to provide a pneumatic valve spring which lends itself to the elimination of valve float as well as being able to accommodate timing changes in the valve train cycle to increase engine power and/or economy.

An additional object of this invention is the provision of a pneumatic valve spring which is constructed to work in the high heat and oily environment of an internal combustion engine with great reliability.

Further objectives of this invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF PREFERRED EMBODIMENTS OF THE DISCLOSED DEVICE

Figure 1:
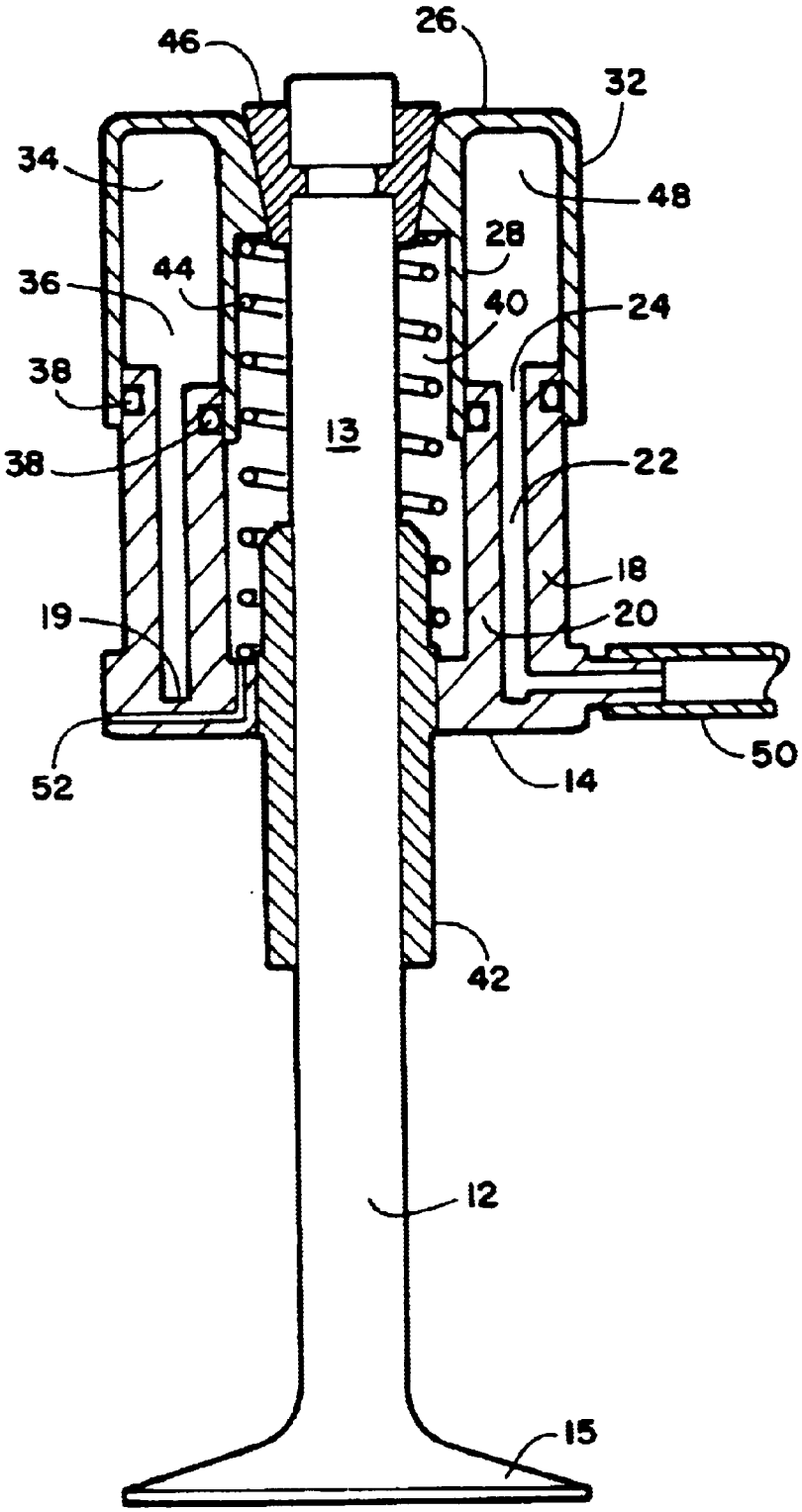
FIG. 1 is a side cut away view of the pneumatic valve spring device engaged around the valve stem in a closed position in an internal combustion or other engine employing reciprocating valves.
Figure 2:
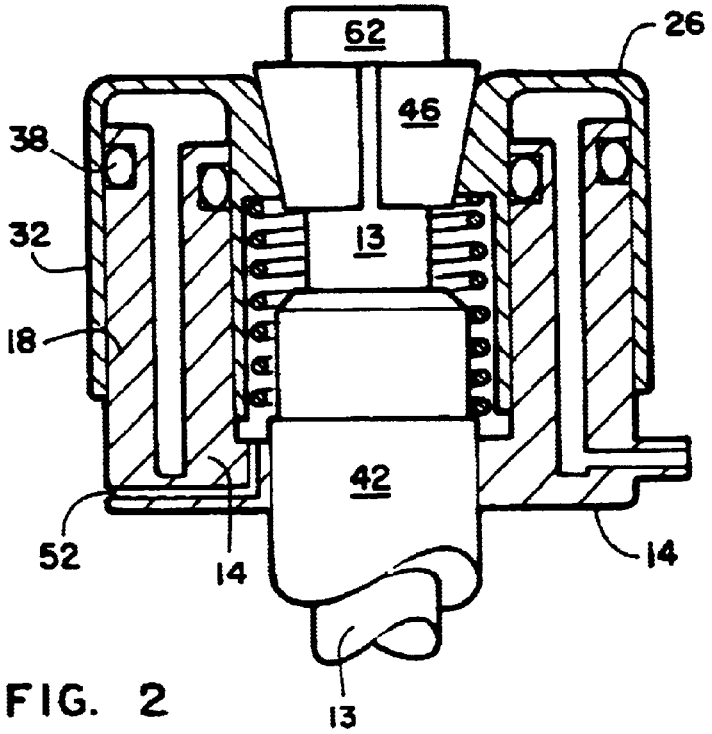
FIG. 2 is a side cut away view of the device with the valve stem in the open position and the static housing reciprocated over the dynamic housing.

Referring now to the drawings, FIGS. 1–4 disclose the pneumatic valve biasing device 10 which is used in combination with valves 12 which reciprocate between open and closed positions in conventional engines and motors which use valves 12 for both intake of fuel mixtures and exhaust of spent gases.

A static housing 14 in the current best embodiment is essentially donut shaped and is mounted to a fixed position engaged with the cylinder head or engine employing the valve 12. A static aperture 16 defined by an outer wall 18 connected by a bottom wall 19 to an inner wall 20 of the static housing 14 surrounds a conventional valve 12 used in combination herewith. The outer wall 18 of the static housing 16 is circumferentially parallel and substantially equidistant from the inner wall 20 and thereby defines a static chamber 22. An opening opposite the bottom wall 19 forms a static circular aperture 24 communicating with the static chamber 22.

The dynamic housing 26, shaped similar to the static housing 14, has an interior wall 28 that surrounds the valve stem 13. The interior wall 28 is connected by a top wall 30 to a circumferentially parallel exterior wall 32 which is substantially equally spaced from the interior wall 28. A reciprocating chamber 34 is defined by the interior wall 28, exterior wall 32, and top wall 30. Communication into the reciprocating chamber 34 is provided at a generally circular opening 36 opposite the top wall 30.

The circular opening 36 of the dynamic housing 26 is sized to accommodate lateral translation of the reciprocating chamber 34 over the interior wall 28 and exterior wall 32 of the static housing 14 with the reciprocating chamber 34 in sealed communication with the static chamber 22 using conventional seals 38 such as O rings adjacent to the engagement of the distal ends of the outer wall 18, inner wall 20, exterior wall 32, and interior wall 28 respectively, to thereby achieve a sealed engagement of the dynamic housing 26 when laterally translating in engagement with the static housing 14.

With the dynamic housing 26 so engaged with the static housing 14, the interior wall 28 sealably engaged with the inner wall 20 define a generally elongated valve stem chamber 40 that is sized to accommodate the valve stem 19 therein and a valve guide 42, if necessary. A biasing means such as a conventional coil spring 44 surrounds the valve stem 13 and biases the dynamic housing 26 attached to the distal end of the valve 12 with a keeper 46, away from the static housing 14 and also imparts a bias to the valve 12 toward a closed position. However, this biasing by the coil spring 44 provides minimal biasing force only to bias the dynamic housing 26 laterally translated away from covering the static housing 16 and helps maintain the dynamic housing 26 cooperatively engaged with the valve stem 13 using the keeper 46, when pressure is off or the engine is off, and thereby properly aligned with its engagement for lateral translation over the static chamber 16. The sealed communication of the reciprocating chamber 34 with the static chamber 22 combine to define an expansion chamber 48 surrounding the valve stem 13. This expansion chamber 48 will both contract and elongate when the dynamic housing 26 reciprocates in its engagement over the static housing 26. Of course, those skilled in the art will readily see that the reciprocating chamber 34 might also translate into the static chamber 22 by changing the inner and outer wall dimensions of both housings, and such is anticipated. However the current best mode of the device features the dynamic housing 26 reciprocating over the static housing 26 and the reciprocating chamber 34 dimensioned to sealably engage and laterally translate over the inner wall 20 and outer wall 18 forming the static chamber 22.

In use, on a conventional valve actuated engine which vents and pressurizes a chamber, a pressurized air fluid supply would be communicated into the static chamber 22 and thereby force the dynamic housing 26 to translate away from the static housing 14 when the supplied pressure expands the expansion chamber 48 formed by the sealed engagement of the static chamber 22 with the reciprocating chamber 34.

The pressurized gas supply 54 would be provided by a pump or other means to provide a pressurized air supply which would best be stored in a tank 55 which would communicate that pressurized gas to the static chamber 22 through one or a plurality of conduits 50 communicating in sealed engagement with the static chamber 22. When so communicated, the pressurized gas pressurizes the expansion chamber 48 formed by sealed and communicating reciprocating chamber 34 and static chamber 22 and forces the dynamic housing 26 and communicating valve 12 away from the static housing 13 thereby biasing the valve into its seat and holding it in biased engagement with a valve seat until the pressure in the formed expansion chamber 48 is vented using a means to vent the expansion chamber 48 such as reversing the flow of pressure through a conduit 50 communicating therewith.

A valving means such as control valve 56 to open and close the communication of the conduit 50 used to pressurize the expansion chamber 48, with the pressurized gas supply 54, would be employed to allow pressurization of the expansion chamber 48 to bias and move the head 15 of the valve 12 toward, and hold it in the biased position in sealed engagement with, the valve seat. This valve means can be employed to control the timing of pressurized gas forced into the static chamber 22 from the conduit 50 using a first control valve 56. Depressurization of the expansion chamber 48 would be accomplished by allowing the control valve 56 to vent the pressure from the expansion chamber 48 allowing a cam or other valve depressing means 62 conventionally used to depress valves 12 to collapse the expansion chamber 48 and vent the gas therein out the conduit 50 thereby opening the valve 12 from its sealed engagement with a seat. Of course, a second conduit 50 might be provided and communicate with the static chamber 22 to allow venting thereof when a second control valve 58 is opened.

The opening and closing of the valves 56 and 58 would be timed with the cycles of the engine to provide a means to time the opening, closing, and holding the valve head in engagement with its seat by allowing for the pressurization and depressurization of the expansion chamber 48. As is obvious to those trained in the art, various other valving schemes might be employed allowing for the pressurization and depressurization of the expansion chamber 48 in correct time and duration with the engine are anticipated. In the current best mode of the device 10 a controller 60 controls the position of one or plurality of valve control means to thereby impart to, and reverse, pressure in the expansion chamber 48 to force the valve 12 to open and to close it. The controller in the current best mode would be electronic and controlling electronic valves but those skilled in the art will recognize that other control means might be used and such are anticipated.

Figure 3:
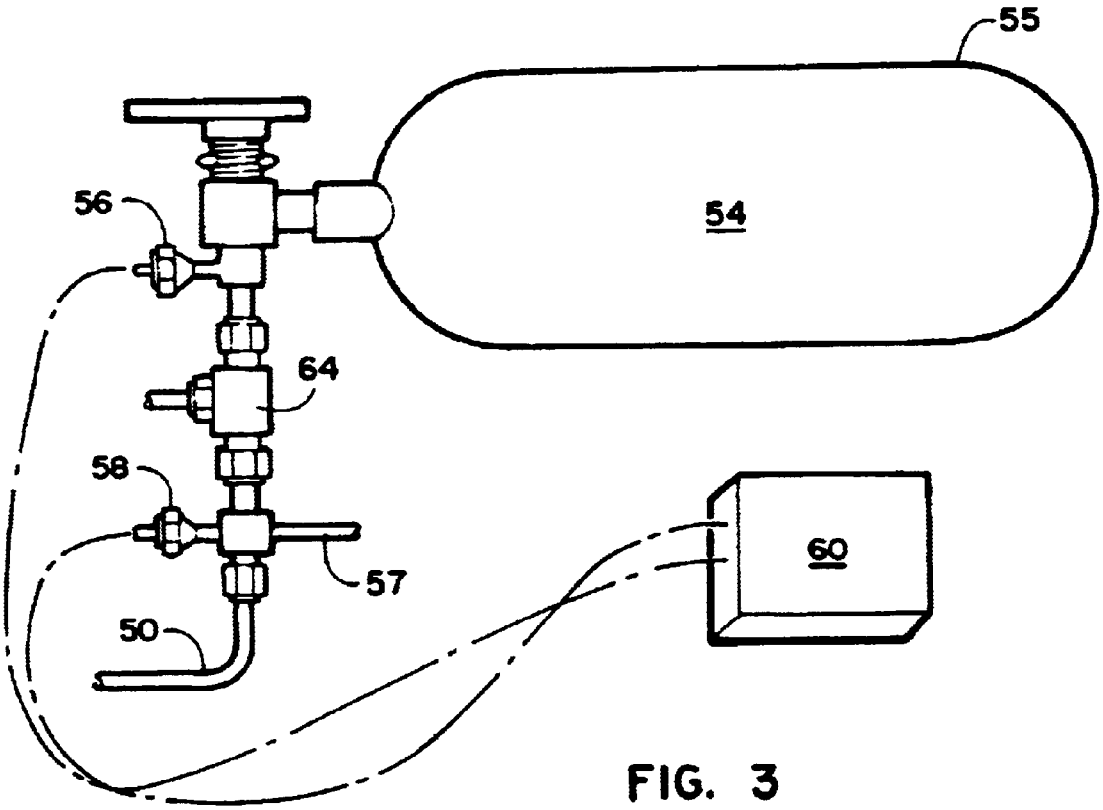
FIG. 3 is a view of a switching system which may provide pressurized air fluid to the individual devices engaged with valve stems which would be timed for variable or fixed duration.
Figure 4:
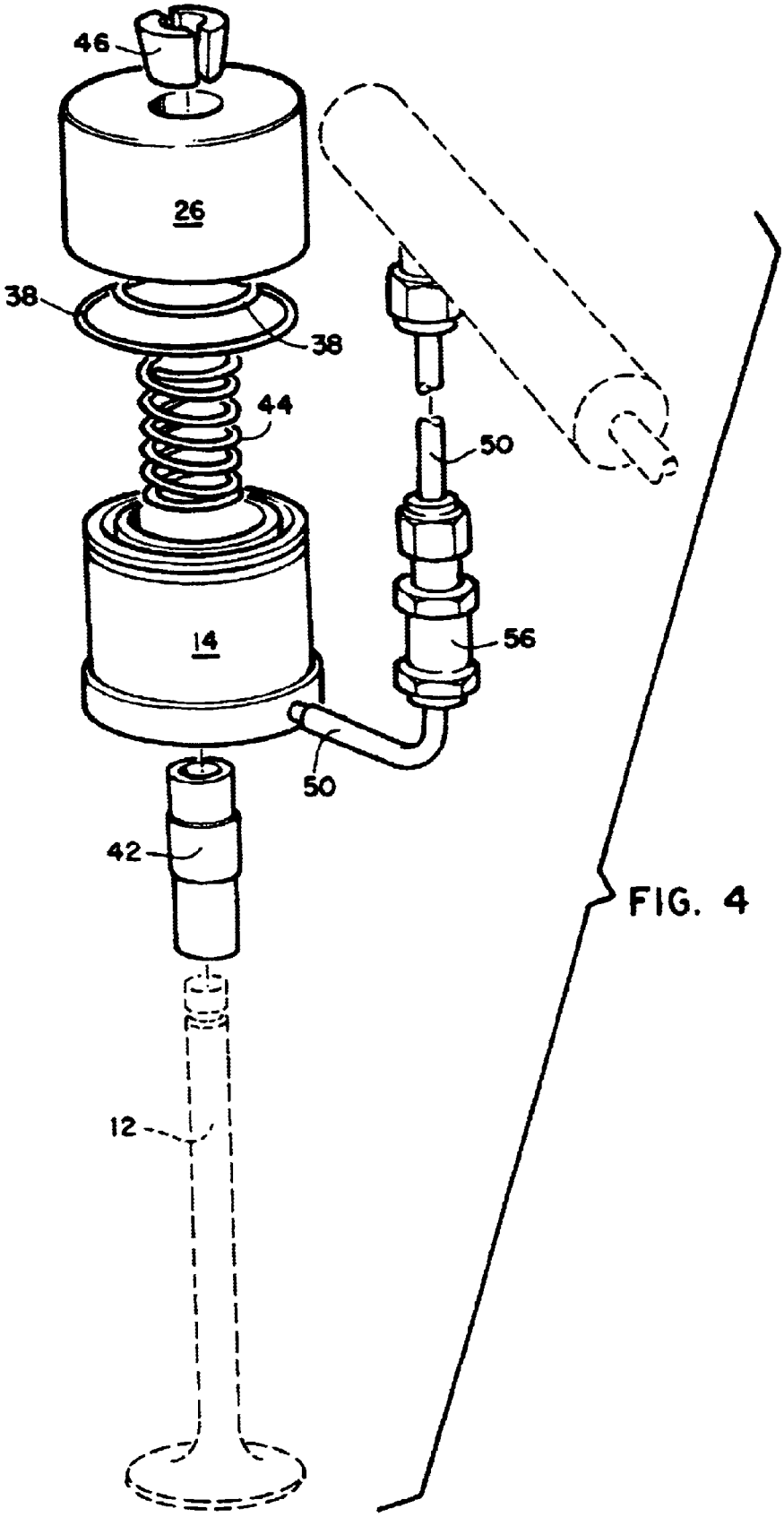
FIG. 4 is an exploded view of the device showing the various components and their engagement around a valve and seat.

The timing of the opening and closing of the valve control means along with the use of a regulator 64 to regulate the pressure and hence the initial force communicated to the static chamber when pressurizing it through the conduit 50, would also provide a means for variable timing of movement of the valve 12 from its open position forced down by the cam or actuating lever 62, to its closed position with the valve head in the seat. This is best depicted in FIG. 3 which shows the use of a plurality of control valves 56 and 58 and a regulator 64 for varying the pressure imparted to the static chamber 22 which will vary the amount of initial force and the time it takes to fully expand the expansion chamber 48. Varying the timing of the valve control means, such as control valves 56 and 58 and the line pressure using the regulator 64 individually or in combination with each other using the controller 60, would allow for timing adjustments, providing a means to vary the valve timing during operation. The regulator may be static in pressure regulation or variable through attachment to the controller 60 which can control the pressure communicated therethrough.

In the preferred embodiment, the air pressure inside the expansion chamber 48 in the unique design of the disclosed device 10 provides a means for keeping pressure from the gas or fluid driving the system out of communication with the valve stem 13 and valve stem chamber 40. This is especially important in retrofitting since no modification is required to the seals around the valve 12 to attach the device 12 to conventional valves 12 on existing engines as would be the case if this area was pressurized. In such a retrofit, because there is no pressure imparted to the valve stem chamber 40, the conventional valve spring could just be removed and replaced with the device 10 without need for modifying the valve stem seals as would be required if the valve stem chamber 40 were to be pressurized. Further, the reciprocating donut design of the device 10 design allows for the device to easily be inserted in place of existing mechanical springs on conventional engines by placing the device in the same spot where the original valve spring occupied and engaging it with the distal end of a valve 12 in the conventional fashion. An optional oil drain passage 52 provides a vent for any oil that might proceed past the valve guide 42 on conventional engines.

While all of the fundamental characteristics and features of the present invention have been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined by the following claims.

What is claimed is:

1. A pneumatic powered valve spring apparatus for use in combination with a reciprocating valve having a first position seated in a valve seat and a second position above said seat, comprising:

a static housing, said static housing having a static chamber formed therein;

a dynamic housing, said dynamic housing having a dynamic chamber formed therein;

means for engagement of said dynamic housing with a valve stem;

said dynamic housing translateably engaged with said static housing with said static chamber in sealed communication with said dynamic chamber;

said dynamic housing having a first position, adjacent to said static housing and a second position translated away from said dynamic housing;

a conduit in sealed communication with said static chamber;

control means engaged with said conduit, said control means having a first state communicating pressurized gas to said static chamber and a second state venting said static chamber through said conduit;

said dynamic housing moving in a first direction from said first position to said second position when said control means is in said first state thereby translating said valve stem in said first direction; and said dynamic housing moving in a second direction from said second position to said first position when said control means is in said second state thereby translating said valve stem a distance in said second direction substantially equal to the distance traveled by said dynamic housing from said second position to said first position.

2. The valve spring apparatus of claim 1 further comprising:

a valve stem chamber formed axially inside said dynamic housing when translateably engaged with said static housing, said valve stem chamber dimensioned to accommodate a valve stem therein in a substantially non pressurized communication therewith.

3. The valve spring apparatus of claim 2 additionally comprising:

biasing means for biasing said dynamic housing toward said first direction.

4. The valve spring apparatus of claim 3 wherein said biasing means is a spring located in said valve stem chamber.

5. The valve spring apparatus of claim 3 wherein said control means engaged with said conduit is a valve;

said valve controlled by a controller; and said controller oscillating said valve from a first position communicating pressurized gas to said static chamber and a second position blocking communication of said pressurized gas to said static chamber and venting said static chamber through said conduit.

6. The valve spring apparatus of claim 2 wherein said control means engaged with said conduit is a valve;

said valve controlled by a controller; and said controller oscillating said valve from a first position communicating pressurized gas to said static chamber and a second position blocking communication of said pressurized gas to said static chamber and venting said static chamber through said conduit.

7. The valve spring apparatus of claim 6 wherein said control means additionally comprises a pressure regulator.

8. The valve spring apparatus of claim 7 wherein said control means is capable of varying the timing of said dynamic housing moving between said first position to said second position by one or a combination of said controller changing the timing of said valve moving from said first position to said second position and varying the pressure imparted through said pressure regulator thereby altering the timing of travel of said valve stem in one or both of said first direction and said second direction.

9. The valve spring apparatus of claim 6 wherein said control means is capable of varying the timing of said dynamic housing moving between said first position to said second position by said controller changing the timing of said valve moving from said first position to said second position thereby altering the timing of travel of said valve stem in one or both of said first direction and said second direction.

10. The valve spring apparatus of claim 1 additionally comprising:

biasing means for biasing said dynamic housing toward said first direction.

11. The valve spring apparatus of claim 10 wherein said control means engaged with said conduit is a valve;

said valve controlled by a controller; and said controller oscillating said valve from a first position communicating pressurized gas to said static chamber and a second position blocking communication of said pressurized gas to said static chamber and venting said static chamber through said conduit.

12. The valve spring apparatus of claim 1 wherein said control means engaged with said conduit is a valve;

said valve controlled by a controller; and said controller oscillating said valve from a first position communicating pressurized gas to said static chamber and a second position blocking communication of said pressurized gas to said static chamber and venting said static chamber through said conduit.

13. The valve spring apparatus of claim 12 wherein said control means additionally comprises a pressure regulator.

14. The valve spring apparatus of claim 13 wherein said control means is capable of varying the timing of said dynamic housing moving between said first position to said second position by one or a combination of said controller changing the timing of said valve moving from said first position to said second position and varying the pressure imparted through said pressure regulator, thereby altering the timing of travel of said valve stem in one or both of said first direction and said second direction.

15. The valve spring apparatus of claim 12 wherein said control means is capable of varying the timing of said dynamic housing moving between said first position to said second position by said controller changing the timing of said valve moving from said first position to said second position thereby altering the timing of travel of said valve stem in one or both of said first direction and said second direction.

* * * * *